United States Patent [19]

Sansum

[11] 4,245,678

[45] Jan. 20, 1981

[54] PACKAGE STRAPPING TOOLS

[75] Inventor: Robert D. Sansum, Harpenden, England

[73] Assignee: Gerrard Industries Limited, South Yorkshire, England

[21] Appl. No.: 42,244

[22] Filed: May 24, 1979

[30] Foreign Application Priority Data

May 25, 1978 [GB] United Kingdom ..... 22591/78

[51] Int. Cl.[3] ..... B21F 21/00

[52] U.S. Cl. ..... 140/93.4; 53/592; 100/30

[58] Field of Search ..... 140/93.2, 93.4; 53/582, 53/589, 592; 100/4, 30

[56] References Cited

U.S. PATENT DOCUMENTS

| | | | |
|---|---|---|---|
| 3,329,178 | 7/1967 | Plunkett | 140/93.4 |
| 3,384,131 | 5/1968 | Sansum | 140/93.2 |

*Primary Examiner*—Richard B. Lazarus

*Attorney, Agent, or Firm*—Kemon & Estabrook

[57] ABSTRACT

In a package strapping tool of the pusher bar type a strap foot restrainer 59 pivoted at 49 to a frame 25 carrying a strap foot 47 is swung clockwise by double-acting auxiliary piston and cylinder assembly 63 from an open position, allowing strapping to be inserted laterally between a rotary dog 50 and strap foot 47, to a closed position (FIG. 4) in which a part 60 of the restrainer 59 engages the underside 61 of the strap foot 47 to support the strap foot 47 against the pressure of the rotary dog 50. In the closed position the restrainer 59 bears against a peg 68 on a carrier, also pivoted at 49 the frame 25, for the rotary dog 50 driven by an air motor 51 and urges the dog 50 against strapping overlying the strap foot 50. The cylinder 65 of the auxiliary piston and cylinder assembly 63 is rigid with the jointing mechanism 22, 27 pivoted to the frame at 45 and the action of the auxiliary piston and cylinder assembly in closing the restrainer also closes the strap foot 47 against a back plate 37 of the jointing mechanism. A tapering toe 48 of the strap foot 47 is thus forced into the angle between the loop of strapping and spare strapping used for tensioning the loop by the dog 50 and finally cut off against the toe 48. In the opposite direction the auxiliary piston and cylinder assembly 63 opens the restrainer 57 and moves the strap foot 47 away from the jointing mechanism.

12 Claims, 10 Drawing Figures

PACKAGE STRAPPING TOOLS

Figure 1:
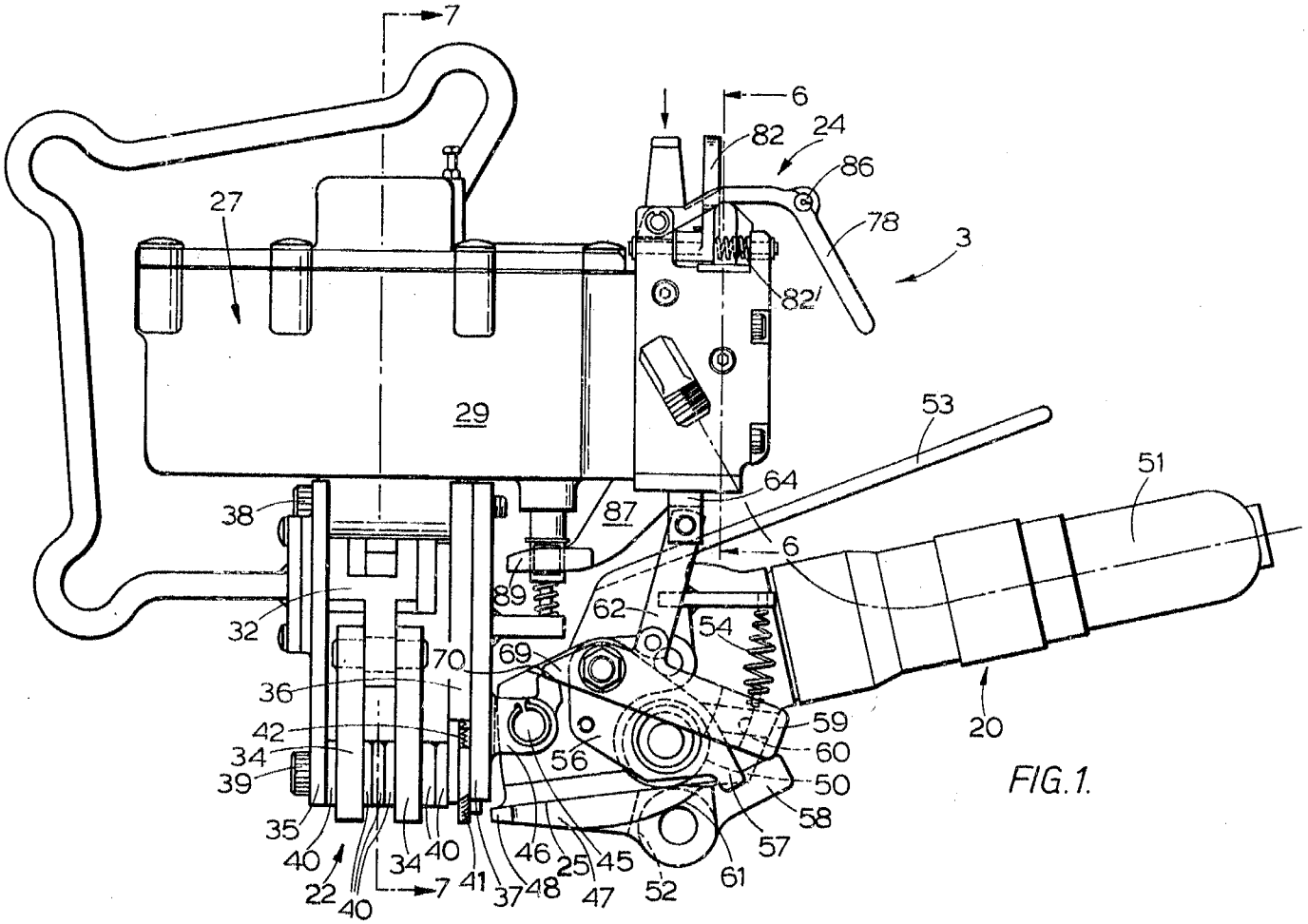

This invention relates to package strapping tools of the so-called "pusher bar" type in which there is no base plate between the loop of strapping and the package to be secured. Tools of this kind are used for strapping irregular shaped packages such as bundles of tubes, steel bars and metal sections which can be regarded as non-compressible and, because of this, no relaxation of tension in the loop is tolerable after removal of the tool.

In strapping tools of the pusher bar type, the jointing mechanism is hinged to a frame supporting the tensioning means to allow the strapping to be inserted laterally into the tensioning means in such a way that a wedge-shaped strap foot, forming part of the frame, is interposed between the loop of strapping close to a seal surrounding the overlapped ends of the loop and the adjacent supply or spare end of the loop. Tension is applied by the tensioning means to the supply or spare end of the loop. After its insertion the strap foot is closed by swinging the jointing mechanism and the frame one towards the other. This brings the toe of the strap foot close to the end of the seal to support the seal and strapping during tensioning and, after the joint has been made, during the cutting off of surplus strapping extending from the joint. Such tools will be referred to hereinafter as package strapping tools of the pusher bar type.

Usually the tensioning means comprises a rotary dog which grips the supply or spare end of the strapping extending from the seal against the strap foot and is rotated to tension the loop by drawing the supply or spare end of the strapping over the surface of the strap foot.

It is an object of the present invention to provide a package strapping tool of the pusher bar type, wherein a strap foot restrainer is mounted on the frame and is movable between an open position in which the side of the strap foot is open for the lateral insertion of strapping into the tool and a closed position in which the strap foot restrainer closes the opening through which the strapping is inserted into the tool and engages the strap foot in a manner supporting the strap foot against forces tending to move it away from the frame.

The strap foot restrainer serves to restrain distortion of the strap foot, for example, due to the load imposed on it by tensioning means having a rotary dog or by the means for cutting off surplus strapping from the joint.

The strap foot restrainer may be pivoted to the frame and move angularly between the open and closed positions. On the strap foot restrainer a supporting surface facing towards the pivotal axis engages, in the closed position, an oppositely directed surface on the strap foot.

The strap foot restrainer is preferably moved by power-operated means which may also serve to open and close the strap foot with respect to the jointing mechanism. When the tensioning means is of the kind including a rotary driving dog, the power-operated means may be arranged to urge the rotary dog towards the strap foot.

For example a piston of a double acting fluid pressure operated auxiliary piston and cylinder assembly, the cylinder of which is mounted to move with the jointing mechanism about the hinge to the frame, may be connected, as by a linkage, to the strap foot restrainer to move it between its open and closed positions. When the auxiliary piston and cylinder assembly is actuated to move the strap foot restrainer towards its closed position, the force applied to the strap foot through the strap foot restrainer may be arranged to urge the strap foot towards the jointing mechanism. When the tensioning means includes a rotary dog, on final movement of the strap foot restrainer in its closing direction the strap foot restrainer may be arranged to bear on a portion of a swingable carrier for the rotary dog to urge the rotary dog against strapping overlying the strap foot.

In the reverse direction, when the strap foot restrainer reaches its open position, a portion of the strap foot restrainer may abut a part of the jointing mechanism to cause the frame and jointing mechanism to move relatively about their hinged joint to move the toe of the strap foot away from the jointing mechanism.

Figure 2:
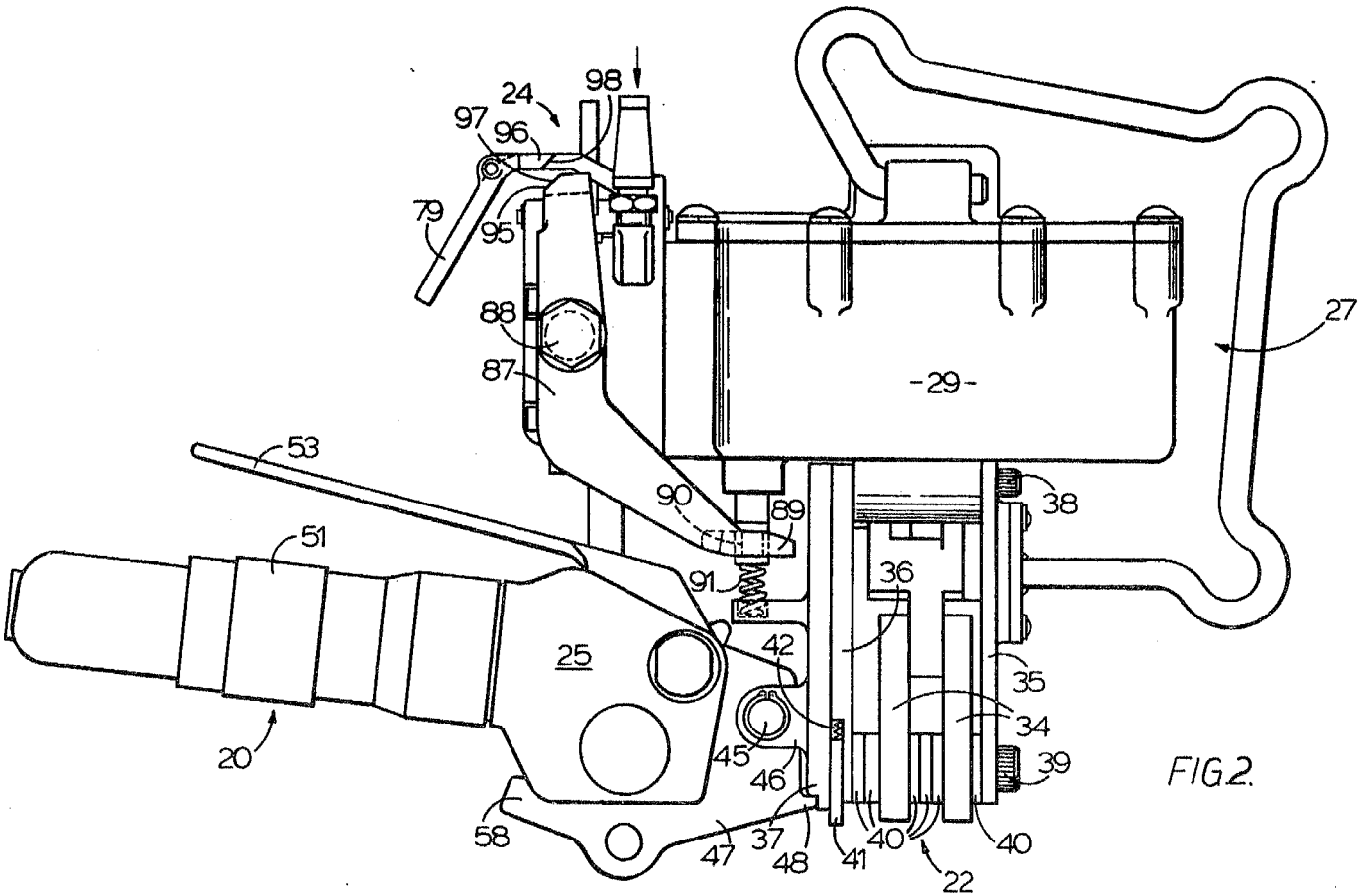
Figure 3:
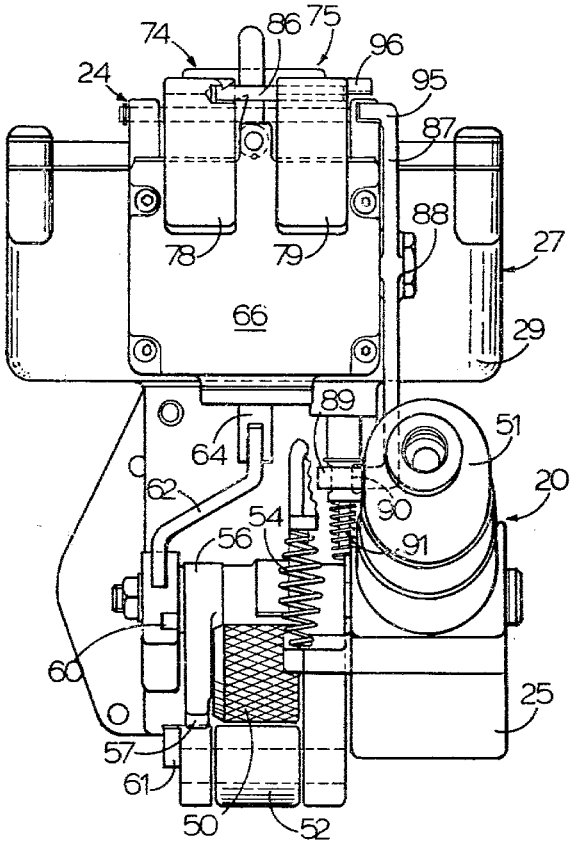
Figure 4:
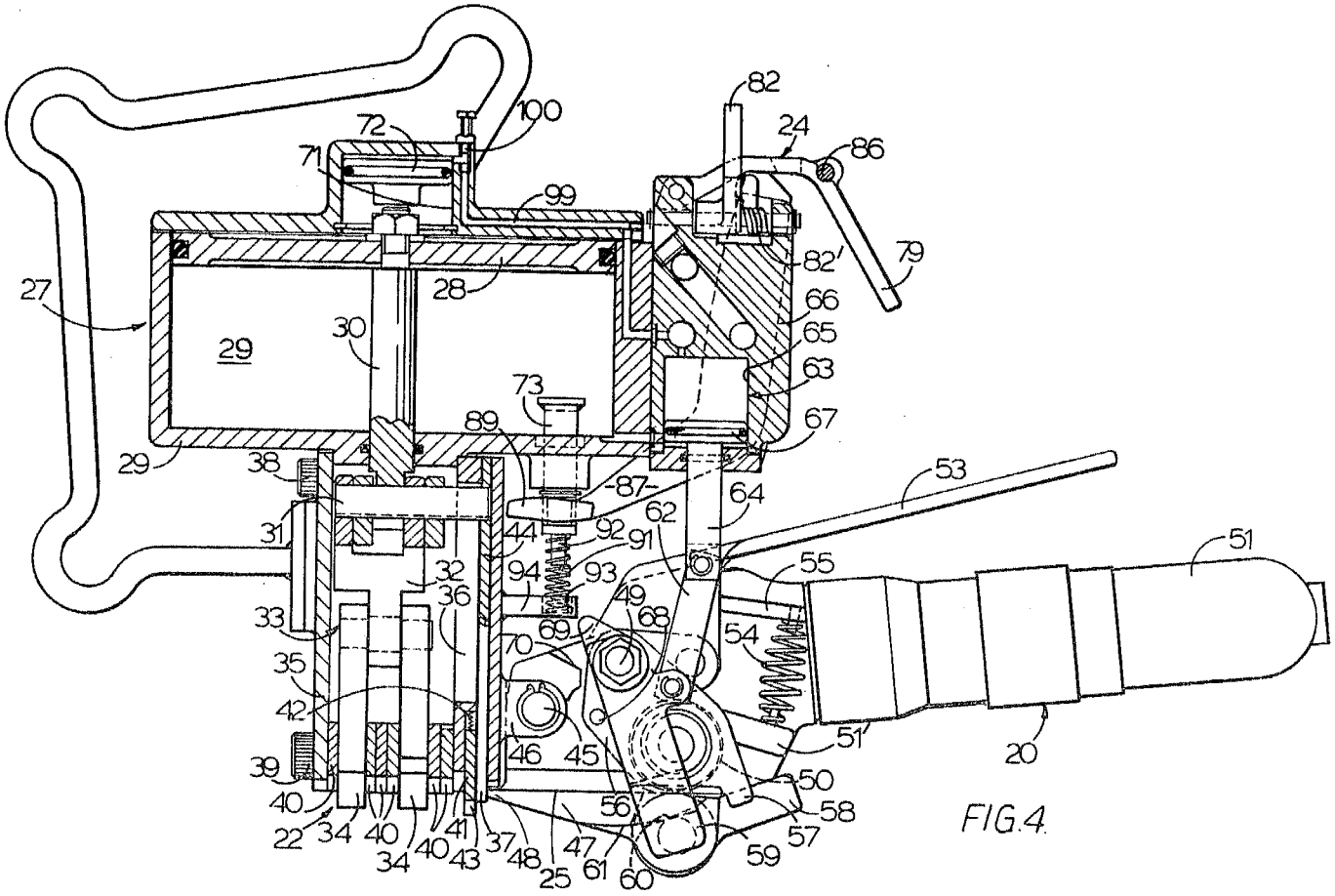
Figure 5:
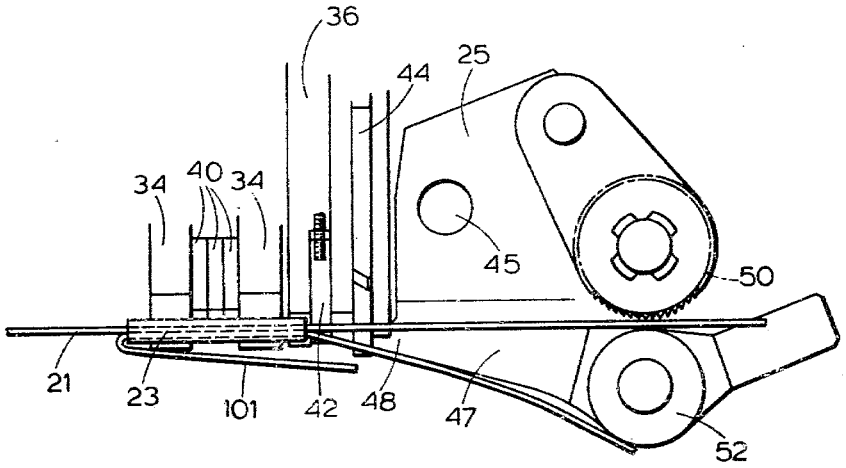
Figure 6:
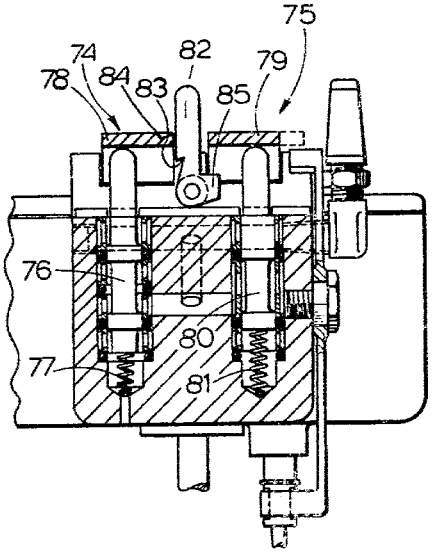
Figure 7:
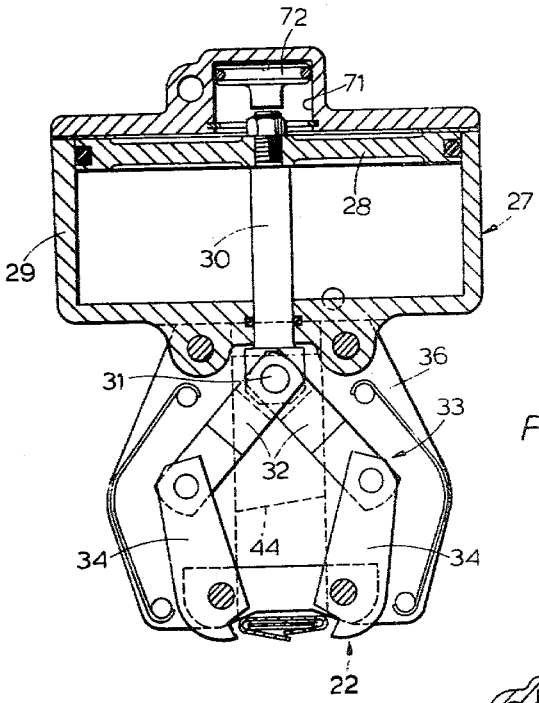
Figure 8:
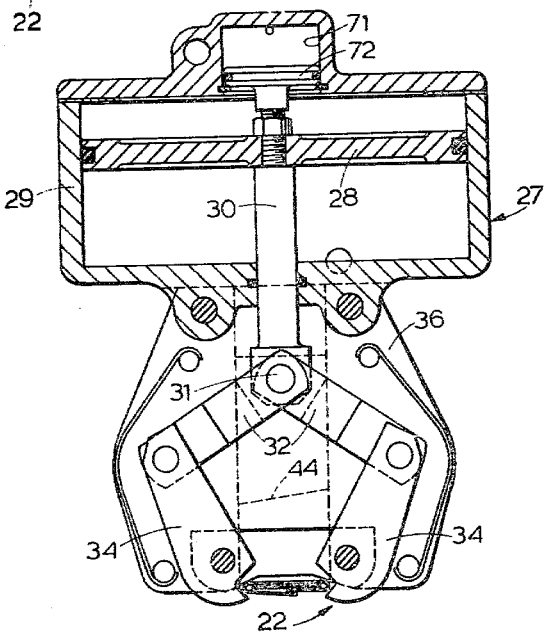
Figure 9:
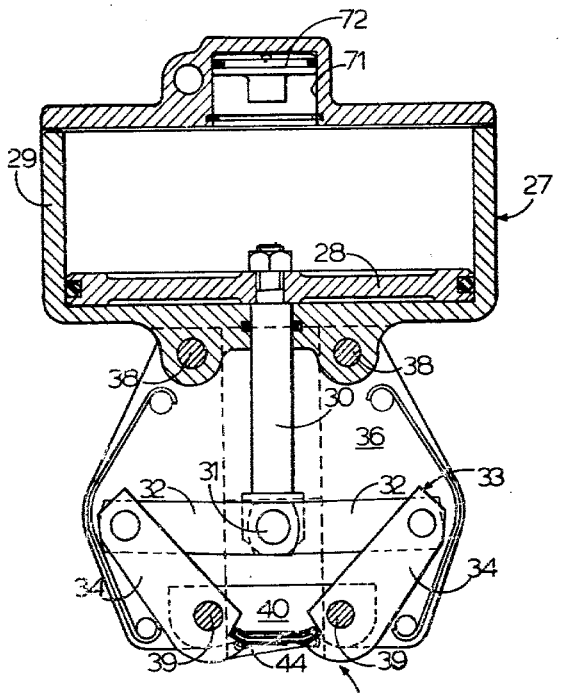
Figure 10:
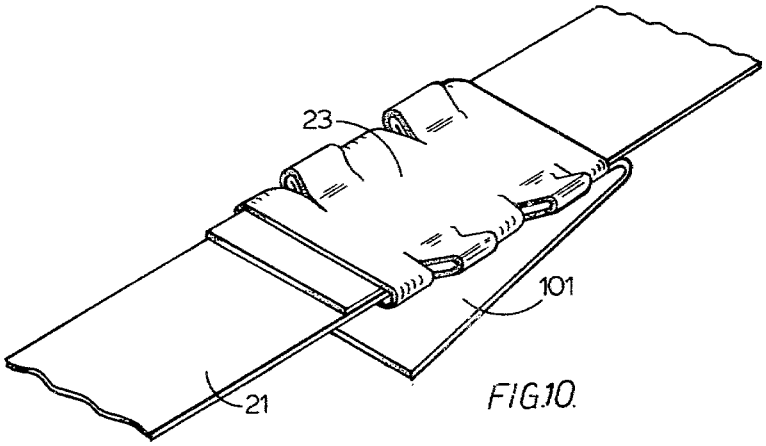

Embodiments of the invention will now be described, by way of example, with reference to the accompanying drawings in which:

FIG. 1 is a front view of one form of strapping tool according to the invention, FIG. 2 is a rear view and FIG. 3 an end view in the direction of arrow 3 in FIG. 1, FIG. 4 is a view similar to FIG. 1 but partly in section, FIG. 5 is a fragmentary view of part of FIG. 4 with the inclusion of package strapping, FIG. 6 is a partial section on line 6—6 of FIG. 1, FIG. 7 is a section on line 7—7 of FIG. 1, FIGS. 8 & 9 are sections similar to FIG. 7 showing different stages in the operation of the tool, FIG. 10 is a perspective view of a completed package strapping joint made by the strapping tool of FIGS. 1 to 9.

The strapping tool illustrated in FIGS. 1 to 9 of the drawings is operated by compressed air and is of the so-called "pusher bar" type which avoids the use of a base plate interposed between the strapping and a package being secured. The strapping tool comprises an air-driven tensioning motor assembly 20 for tightening a metal strap 21 (FIGS. 5 and 10) around the package, a crimping device 22 for securing together overlapping portions of the strap 21 within a surrounding metal seal 23 and a valve assembly 24 by which the operation of the strapping tool is controlled.

The tensioning motor assembly 20 and the crimping device 22 are both pivoted to a frame 25 to enable the tool to be opened for easier engagement with a loop of strapping and closed for operating upon it.

The crimping device 22 is operated by a large double acting piston and cylinder assembly 27 with a piston 28 (FIG. 4) working in a cylinder formed in a housing 29. The piston 28 is mounted on a piston rod 30 which extends through the bottom of the housing 29 to be connected by a transverse pin 31 (FIGS. 4 and 7) to a pair of links 32 of a toggle linkage 33 for operating crimping jaws 34. A front plate 35 lies on one side of the toggle linkage. An intermediate plate 36 and a back plate 37, in contact with one another, lie parallel to the front plate 35 on the opposite side of the toggle linkage. The plates 35, 36 and 37 are secured to the housing by bolts 38 and further bolts 39 near the lower corners of the plate provides pivots for the jaws 34. The bolts 39 also support fixed blades 40 against each face of each jaw 34 with which they co-operate to crimp the seal and make the joint in the strapping.

A seal stop 41 is slidably mounted in the intermediate plate 36 and urged towards a projecting position by a spring 42. A gap 43 (FIG. 4) is provided in the bottom edge of the seal stop 41 to receive the strapping so that the seal stop 41 straddles it and acts as a guide during tensioning as well as providing an abutment for the rear end of the seal. In the face of the back plate 37 that is against the intermediate plate 36 is formed a slideway for a cutter 44. As visible in FIG. 4 the transverse pin 31 projects through a slot in the intermediate plate 36 to engage a hole in the cutter 44 which is therefore moveable along the slideway by the pin 31.

The crimping device 22 is pivoted to the frame 25 by a pivot pin 45 which passes through lugs 46 projecting from the back plate 37 and a bore in the frame 25. Forming part of the frame 25 is a strap foot 47 which tapers towards a toe 48. In the closed pisitions of the tool the toe 48 bears against the bottom edge of the back plate 37 and the front edge projects forward to a position in which it co-operates with the cutter 44 in severing surplus strapping from the completed joint.

The motor assembly 20 is pivoted to the frame 25 by a pivot pin 49. A rotary dog 50 (FIGS. 1, 3 and 4) for tensioning the strap is driven by an air motor 51 of the motor assembly 20 through suitable gearing. There is a roller 52 rotatably mounted in the strap foot 47 opposite the rotary dog 50 to support the strap against the pressure of the rotary dog during tensioning. The roller 52 is rotatable with the object of reducing friction.

A hand lever 53 rigidly mounted on the frame 25 extends above the body of the motor 51. By squeezing the hand lever 53 and motor 51 together, the motor 51 can be raised to lift the rotary dog 50 away from the strap foot to enable the strap to be inserted between the rotary dog 50 and the roller 52. A barrel-shaped compression spring 54 mounted between a bracket 55 rigid with the hand lever 53 and a lug 51' on the casing of the motor assembly urges the rotary dog 50 towards the roller 52. An outrigger bracket 56 supported by the motor pivot 49 carries an outer end bearing for the shaft on which the rotary dog 50 is mounted. A downward projection 57 of the outrigger bracket forms an outer edge strap guide and an upwardly inclined tail 58 on the strap guide provides a guide for the inner edge of the strap. Outside the outrigger bracket 56 a strap foot restrainer 59 (FIGS. 1, 3 and 4) is swivelly mounted on the motor pivot 49. On its inner face the strap foot restrainer 59 has an arcuate groove 60 to receive a lateral projection 61 on the strap foot when the strap foot restrainer 59 is swung downwards. The under face of the projection 61 has a curved surface centred on the motor pivot 49 and engages the facing side of the groove 60 to resist deflection of the strap foot during strap tensioning. A link 62 couples the strap foot restrainer 59 to an auxiliary double-acting piston and cylinder assembly 63. The link 62 is pivotally connected to the strap foot restrainer 59 and to a piston rod 64. A cylinder 65 (FIG. 4) of the piston and cylinder assembly 63 is formed in a body 66 of the valve assembly 24 and its piston 67 is connected to the piston rod 64. In its outstroking direction the piston 67 swings the strap foot restrainer 59 clockwise (as viewed in FIGS. 1 and 4) engaging the lateral projection 61 with the groove 60. The movement continues until the strap foot restrainer 59 meets a peg 68 protruding from the outrigger bracket 56 on which it acts to urge the motor assembly 20 about the motor pivot 49 in a clockwise direction (as shown in FIG. 4) so as to urge the rotary dog 50 harder against the strapping. If frictional contact between the strap foot restrainer 59 and the strap foot 47 has not already caused the strap foot 47 to move towards the crimping device 22, the force applied to the strap foot 47 through the rotary dog 50, by the action of the auxiliary piston and cylinder assembly 63, will urge the toe 48 of the strap foot 47 towards the back plate 37.

In the opposite direction the auxiliary piston and cylinder assembly 63 moves the strap foot restrainer 59 anti clockwise, disengaging its groove 60 from the lateral projections 61 and out of the way of the strap being inserted between the rotary dog 50 and the roller 52. Towards the end of the anti-clockwise movement of the strap foot restrainer 59 a tail 69 of the strap foot restrainer 59 engages an abutment 70 (FIGS. 1 and 4) on the frame 25 so that the strap foot restrainer 59 and the frame 25 together move anti-clockwise about the pivot pin 45 swinging the strap foot 47 away from the back plate 37 ready for engagement of the tool with the loop of strapping.

In the cylinder housing 29 above the large piston 28 is a small co-axial partial-closed cylinder 71 (FIGS. 4 and 7 to 9) with a piston 72 which abuts the large piston 28 when the piston 28 is at the top of its stroke. When air under pressure is admitted to the top of the partial close cylinder 71, the piston 72 moves from the position shown in FIG. 7 and bears on the large piston 28 and moves the piston rod 30 to close the crimping jaws 34 around the seal 23 (as shown in FIG. 8) whilst strap tensioning takes place. By this means the seal 23 is retained and prevented from being pulled out of the jaws as a result of curvature or irregularities in the package surface.

At the bottom of the cylinder housing 29 a plunger 73 (FIG. 4) is slidably mounted for movement parallel to the piston rod 30. It is spring biased to project into the cylinder. Towards the lower end of its stroke the piston 28 depresses the plunger 73 indicating that the crimping operation powered by the piston and cylinder assembly 22 has been completed. The way in which use is made of this indication will be described later.

The valve assembly 24 comprises a tension valve 74 and a sealing valve 75. The tension valve has a sliding valve spool 76 (FIG. 6) urged upwards by a spring 77 against a pivoted tension valve lever 78 by which the spool 76 can be manually depressed. Moving the tension valve spool downwards supplies compressed air under pressure to the top of the piston 67 of the auxiliary piston and cylinder assembly 63, and opens its underside to atmosphere, supplies air to the air motor 51 and to the top of the co-axial cylinder 71 through a passage 99 (FIG. 4). The underside of the large piston 28 is also opened to atmosphere. The passage 99 includes a screw-down valve 100 which enables the passage 99 to be closed so that pressure air can be prevented from reaching the co-axial cylinder 71 if the previously described action of the piston 72 in partly closing the crimping device is not required.

Similarly a pivoted sealing valve lever 79 provides manual control of a valve spool 80 of the sealing valve 75. The valve spool 80 is urged upwards by a spring 81. Moving the sealing valve spool 80 downwards supplies pressure air to the top of the cylinder of the main piston and cylinder assembly 27. A catch 82 (FIGS. 1, 4 and 6) pivotally mounted between the levers 78 and 79 is urged by a spring 82' anti-clockwise (as viewed in FIG. 6) towards the tension valve lever 78 and has a notch 83 to engage a recess 84 in the tension valve lever 78. The notch 83 of the catch 82 self-engages the recess 84 when the tension valve lever 78 is depressed and retains that lever in the depressed postion. The catch 82 also has a tail 85 which lies under the sealing valve lever 79. When the sealing valve lever is depressed it engages the tail 85 and trips the catch 82 disengaging its notch 83 from the recess 84. However, rigid with the sealing valve lever 79 is a hold-down pin 86 (FIGS. 1, 3 and 4) which projects over the tension valve lever 78. When the catch 82 is tripped the tension valve lever 79 rises into engagement with the hold-down pin 86 but not sufficiently to alter the effective position of the tension valve spool 76.

A cranked lever 87 (FIGS. 2, 3 and 4) is pivotally mounted about a pivot pin 88 on the body 66 of the valve assembly 24. The lower end of the cranked lever 87 extends under the edge of the cylinder housing 29 and has a lateral extension 89 which is bifurcated and embraces a circumferential groove 90 in the plunger 73 where it projects below the cylinder housing 29. The upper end of a helical compression spring 91 surrounds a spigot 92 at the lower end of the plunger 73. The lower end of the spring 91 is received in a pocket 93 in a lug 94 projecting from the back plate 37. The spring 91 urges the plunger 73 upwards and the cranked lever 87 in an anti-clockwise direction in FIG. 2. At its upper end the cranked lever 87 has a lateral projection 95 (FIG. 3) which extends towards the sealing lever 79 and lies in the path which a lateral projection 96 on the sealing lever 79 follows when the sealing lever 79 is depressed. Meeting faces 97, 98 (FIG. 2) on the projections 95 and 96 respectively are complementarily inclined so that when the sealing lever 79 is depressed the projection 95 on the sealing lever deflects the projection 96 moving the cranked lever 87 (clockwise in FIG. 2) against the action of the spring 91 until the projection 95 has passed the projection 96 when the spring urges the projection 96 to overlie the projection 95 and retain the sealing lever 79 in the operative position. The plunger 73, cranked lever 87, spring 91 and the overlapping projections 95, 96 thus constitutes a self-engaging latch to retain the sealing lever 79 in the operative position until the plunger 73 is engaged by the piston 28 at the end of of its downwards movement. The piston 28 reaches this position when the sealing operation has been completed. Depression of the plunger 73 by the piston 28 releases the latch so that the sealing lever 79 withdraws the hold-down pin 86 from the tension lever 78 which, too, returns to its initial position under the pressure of the tension valve spool spring 77.

A summary of the full cycle of operation of the strapping tool is as follows. In the starting condition shown in FIGS. 1 and 7 pressure air is being supplied through the sealing valve spool 80 to the underside of the piston 28 so that the crimping jaws 34 are held wide open. Pressure air is also being supplied by the tension valve spool 76 to the underside of the piston of the auxiliary piston and cylinder assembly 63. This holds the strap foot restrainer 59 in its upper position and the toe 48 of the strap foot 47 is separated from the back plate 37.

A metal seal 23 is slipped over the end of a length of strapping 21 drawn from a supply reel. The strapping is pulled through the seal and is looped around a package. The free end is threaded again through the seal below the supply end of the strapping loop and the projecting portion 101 (FIGS. 5 and 10) bent back under the seal. The end of the loop nearest the supply reel is inserted sideways into the tool between the rotary dog 50 and the roller 52. To create a gap for this purpose between the rotary dog 50 and the roller 52 the air motor 51 is lifted by squeeezing together the air motor 51 and the hand lever 53. The seal 23 is arranged under the crimping jaws 34 and the strap foot occupies the angle between the strapping of the loop and the portion leading to the supply. The slack in the strapping is pulled up manually until the end of the seal abuts against the seal stop 41.

The tension lever 78 is then depressed and is held in this position by the catch 82. The resulting reversal of the pressure air supply to the auxiliary piston and cylinder assembly 63, so that it is now applied to the top of the piston, closes the strap foot restrainer 59 (as shown in FIG. 4), urges the strap foot towards the back plate 37, and urges the rotary dog 50 against the strapping. Air pressure is simultaneously applied to the partial-close cylinder 71 partially to close the crimping jaws 34 to grasp and locate the seal, as shown in FIG. 8, and to the air motor 51 which drives the rotary dog 50 to tension the strapping.

The strapping is fully tensioned when the motor stalls. The operator then depresses the sealing lever 79 to apply air pressure to the top of the piston 28. The crimping jaws 34, as shown in FIG. 9, form the joint between the overlapping ends of the loop of strapping and the cutter 44 co-operates with the toe 48 of the strap foot to cut off the loop from the supply of strapping. When the main piston 28 reaches the bottom of its stroke, on completing the crimping and cutting off operation, it strikes the plunger 73 so that the sealing lever 79 is released as previously described.

Release of the sealing lever 79 also releases the tension lever 78 allowing the respective spool springs to restore the sealing valve spool 70 and tension valve spool 76 to their initial positions. Back in their initial postions, the valve spools cut-off the pressure air supply to the motor and supply it instead to the underside of the main piston 28, re-opening the crimping jaws 34 so that the tool can be removed from the package, and to the underside of the piston of the auxiliary piston and cylinder asembly 63 swinging the strap foot restrainer 59 up into the open position and bringing its tail 69 into engagement with the abutment 70 to withdraw the strap foot 47 from the back plate 37 ready for the next loop of strapping. The form of the resulting joint is shown in FIG. 10.

The screw-down valve 100 allows air from the tension valve spool 76 to be cut off from the partial close cylinder 71 so that the intermediate movement of the crimping jaws 34 to grip the seal 23 as shown in FIG. 8 does not take place. This may be desirable for various operational reasons, for example, to run the tool along the strapping 21 for some distance up to the seal 23.

I claim:

1. A package strapping tool for tightening a loop of metal strapping around a package and for forming a joint between overlapping ends of said loop at a seal surrounding said overlapping ends said tool being of the pusher bar type comprising a frame, tensioning means supported by said frame, a jointing mechanism, a hinge swingably connecting said jointing mechanism to said frame, a wedge-shaped strap foot mounted on said frame, said strap foot having a toe at the thin end of said wedge-shaped, said toe being closable against said jointing mechanism and openable therefrom by hinging movement between said frame and said jointing mechanism and said strap foot being interposed, in use of said tool, between the loop of strapping close to said seal and the adjacent spare end of the loop characterised by a strap foot restrainer mounted on said frame and movable between an open position in which one side of said strap foot leaves an opening for the lateral insertion of strapping into the tool and a closed position in which said strap foot restrainer closes the opening through which the strapping is inserted into the tool and engages said strap foot in a manner supporting said strap foot against forces tending to move said strap foot away from said frame.

2. A package strapping tool according to claim 1 wherein the strap foot restrainer supports the strap foot against the load imposed on the strap foot by said tensioning means or by means for cutting off surplus strapping from the joint.

3. A package strapping tool according to claim 1 wherein the strap foot restrainer is pivoted to said frame and is movable angularly between said open and closed positions, said strap foot restrainer having a supporting surface facing towards the pivotal axis and said strap foot having an oppositely directed surface engageable, in said closed position, by said supporting surface.

4. A package strapping tool according to claim 1 and further comprising power-operated means for moving said strap foot restrainer between said open and said closed positions.

5. A package strapping tool according to claim 4 wherein the power-operated means is arranged also to close the strap foot by swinging said frame and said jointing mechanism one towards the other.

6. A package strapping tool according to claim 5 wherein said power-operated means is an auxiliary piston and cylinder assembly the cylinder of which is mounted to move with said jointing mechanism about said hinge of said frame, the tool further comprising means for connecting the piston of said auxiliary piston and cylinder assembly to said strap foot restrainer to move it between said open and closed positions.

7. A package strapping tool according to claim 6 wherein, when said power-operated means is actuated to move the strap foot restrainer towards its closed position, the force applied by said power-operated means to said strap foot through said strap foot restrainer is arranged to urge said strap foot towards said jointing mechanism.

8. A package strapping tool according to claim 7 wherein said power-operated means is arranged also to open the strap foot by swinging said frame and jointing mechanism one away from the other.

9. A package strapping tool according to claim 8 wherein said jointing means has an abutment, upon movement of said strap foot restrainer towards its open position, the strap foot restrainer being arranged to abut said abutment to cause the frame and jointing mechanism to move relatively about the hinge to move the toe of the strap foot away from the jointing mechanism.

10. A package strapping tool according to claim 1 and further comprising power-operated means for moving said strap foot restrainer between said open and said closed positions and wherein said tensioning means is of the kind having a rotary dog, said rotary dog being urged towards said strap foot by said power-operated means.

11. A package strapping tool according to claim 10 and further comprising a swingable carrier for said rotary dog wherein upon final movement of said strap foot restrainer towards said closed position, said strap foot restrainer is arranged to bear on a portion of said swingable carrier to urge said rotary dog, in use, against strapping overlying said strap foot.

12. A package strapping tool according to claim 1 wherein said tensioning means includes a carrier pivoted to said frame and a rotary dog mounted in said carrier said tool including an auxiliary piston and cylinder assembly having its cylinder mounted to move with said jointing mechanism about said hinge of said frame, a linkage connecting the piston of said auxiliary piston and cylinder assembly to said strap foot restrainer so as to swing said strap foot restrainer between said open and said closed positions, in said open position said strap foot restrainer being arranged to bear on said frame to open said strap foot and in said closed position to bear on said carrier so as to close said strap foot and urge said rotary dog towards said strap foot and, in use of the tool, against strapping overlying said strap foot.

* * * * *